US009754481B2

(12) United States Patent
Liu et al.

(10) Patent No.: US 9,754,481 B2
(45) Date of Patent: Sep. 5, 2017

(54) METHOD FOR PROCESSING KEY VALUE INFORMATION OF REMOTE CONTROL, CONTROL DEVICE AND REMOTE CONTROL

(71) Applicant: Huawei Device Co., Ltd., Shenzhen (CN)

(72) Inventors: Xiaoling Liu, Shenzhen (CN); Zhiqin He, Shenzhen (CN); Liu Fang, Shenzhen (CN)

(73) Assignee: HUAWEI DEVICE CO., LTD., Shenzhen (CN)

( * ) Notice: Subject to any disclaimer, the term of this patent is extended or adjusted under 35 U.S.C. 154(b) by 37 days.

(21) Appl. No.: 14/717,294

(22) Filed: May 20, 2015

(65) Prior Publication Data

US 2015/0262476 A1 Sep. 17, 2015

Related U.S. Application Data

(63) Continuation of application No. PCT/CN2013/087496, filed on Nov. 20, 2013.

(30) Foreign Application Priority Data

Nov. 20, 2012 (CN) ..... 2012 1 0470691

(51) Int. Cl.
*G08C 17/02* (2006.01)
*G08C 23/04* (2006.01)

(52) U.S. Cl.
CPC ..... *G08C 17/02* (2013.01); *G08C 23/04* (2013.01); *G08C 2201/20* (2013.01)

(58) Field of Classification Search
CPC G08C 2201/21; G08C 2201/92; G08C 17/02; G08C 19/28; G08C 2201/20;
(Continued)

(56) References Cited

U.S. PATENT DOCUMENTS 5,081,534 A * 1/1992 Geiger ..... H04N 5/765 340/12.23
6,127,941 A * 10/2000 Van Ryzin ..... G08C 17/02 340/12.53

(Continued)

FOREIGN PATENT DOCUMENTS

CN 101183487 A 5/2008
CN 101493988 A 7/2009

(Continued)

OTHER PUBLICATIONS

Partial English Translation and Abstract of Chinese Patent Application No. CN101727735, Jun. 20, 2016, 15 pages.

(Continued)

*Primary Examiner* — Fekadeselassie Girma
(74) *Attorney, Agent, or Firm* — Conley Rose, P.C.

(57) ABSTRACT

A method for processing key value information of a remote control, a control device, and a remote control are provided. The present application can avoid a problem, in the prior art, of reduced operation efficiency and reduced operation reliability caused by the need of simultaneous operations on two remote controls. By using the technical solution provided by this embodiment of the present invention, it may be implemented that another remote control is synchronously set by performing operations on one remote control and displaying, by using a display device, a to-be-learned button on the another remote control, which is easy to operate and thereby improves operation efficiency and operation reliability.

25 Claims, 6 Drawing Sheets

(58) Field of Classification Search
CPC G08C 2201/30; G08C 23/04; G08C 2201/41; G08C 2201/50; G08C 17/00; G08C 2201/33; H04N 2005/4435; H04N 21/42226; H04N 21/482; H04N 5/4403; H04N 2005/4439; H04N 21/4126; H04N 21/4222; H04N 21/42225; H04B 1/202
USPC ..... 340/12.23, 12.28, 12.53, 12.22, 12.5, 340/12.24, 12.25, 12.52, 12.54, 12.55, 340/13.24, 4.3, 4.37
See application file for complete search history.

(56) References Cited

U.S. PATENT DOCUMENTS 7,525,473 B2 * 4/2009 Chu ..... G08C 17/00 340/12.28
7,535,465 B2 * 5/2009 Morse ..... G11B 27/105 345/204
8,176,514 B2 * 5/2012 Yi ..... H04N 5/44543 725/41
8,348,145 B2 * 1/2013 Pratt ..... H04L 12/2814 235/375
8,627,364 B2 * 1/2014 Song ..... H04W 4/06 725/109
8,797,151 B2 * 8/2014 Ohashi ..... G08C 17/02 340/12.22
8,890,664 B2 * 11/2014 Edwards ..... G08C 19/28 340/12.22
9,024,733 B2 * 5/2015 Wouters ..... G08C 19/28 340/10.5
2004/0070491 A1 * 4/2004 Huang ..... G08C 17/02 340/10.5
2005/0157217 A1 * 7/2005 Hendricks ..... H04H 20/06 348/734
2008/0174468 A1 * 7/2008 Drimusz ..... G08C 19/28 341/176
2009/0070696 A1 * 3/2009 Belz ..... G06F 3/0489 715/771
2009/0079594 A1 * 3/2009 Arling ..... H04N 5/44 341/22
2010/0053468 A1 * 3/2010 Harvill ..... H04N 5/4403 348/734
2010/0060506 A1 * 3/2010 Maier ..... G08C 17/02 341/176
2010/0162331 A1 * 6/2010 Belz ..... H04L 12/2803 725/106
2010/0208145 A1 * 8/2010 VanDuyn ..... G08C 19/28 348/734
2011/0055865 A1 * 3/2011 Jung ..... H04N 5/4403 725/38
2011/0109444 A1 * 5/2011 Edwards ..... G08C 19/28 340/12.23
2011/0157478 A1 * 6/2011 McRae ..... H04N 5/4403 348/734
2011/0164189 A1 * 7/2011 Asayama ..... G08C 17/00 348/734
2011/0312272 A1 * 12/2011 Goto ..... G08C 17/02 455/41.1
2012/0021684 A1 * 1/2012 Schultz ..... H04B 5/0043 455/41.1
2012/0280802 A1 * 11/2012 Yoshida ..... G08C 17/02 340/12.5
2015/0371536 A1 * 12/2015 Skokna ..... H04N 21/4586 398/106

FOREIGN PATENT DOCUMENTS

CN 101727735 A 6/2010
CN 101751767 A 6/2010
CN 102104710 A 6/2011
CN 102610084 A 7/2012
CN 102665124 A 9/2012
EP 0354459 B1 3/1994
JP 11252404 A 9/1999

OTHER PUBLICATIONS

Foreign Communication From a Counterpart Application, Chinese Application No. 201210470691.2, Chinese Office Action dated May 5, 2016, 9 pages.
Partial English Translation and Abstract of Chinese Patent Application No. CN101183487A, May 27, 2015, 3 pages.
Partial English Translation and Abstract of Chinese Patent Application No. CN102610084A, May 27, 2015, 2 pages.
Foreign Communication From a Counterpart Application, PCT Application No. PCT/CN2013/087496, English Translation of International Search Report dated Feb. 27, 2014, 3 pages.
Foreign Communication From a Counterpart Application, PCT Application No. PCT/CN2013/087496, English Translation of Written Opinion dated Feb. 27, 2014, 19 pages.
Foreign Communication From a Counterpart Application, European Application No. 13856913.2, Extended European Search Report dated Dec. 15, 2015, 7 pages.

* cited by examiner

METHOD FOR PROCESSING KEY VALUE INFORMATION OF REMOTE CONTROL, CONTROL DEVICE AND REMOTE CONTROL

CROSS-REFERENCE TO RELATED APPLICATIONS

This application is a continuation of International Application PCT/CN2013/087496, filed on Nov. 20, 2013, which claims priority to Chinese Patent Application No. 201210470691.2, filed on Nov. 20, 2012, both of which are incorporated herein by reference in their entireties.

TECHNICAL FIELD

The present application relates to communications technologies, and in particular, to a method for processing key value information of a remote control, a control device, and a remote control.

BACKGROUND

With the rapid development of remote control technologies, as important input devices for electronic devices, remote controls become quite popular. There may be a large variety of electronic devices, for example, television sets, set-top boxes, and air conditioners, in one location; and accordingly, there are also many types of remote controls for these electronic devices. This causes many inconveniences to operators. For the foregoing problem, a solution is proposed in the prior art, in which one remote control may obtain, according to operations of an operator on the one remote control and corresponding buttons on another remote control, a correspondence of key value information between buttons on the one remote control and buttons on the another remote control, so as to implement that the one remote control can control two or more electronic devices. For example, an operator may separately press corresponding buttons on remote control A and remote control B, for example, the operator presses button C on remote control A, and the operator presses button D on remote control B; then, remote control A may receive key value information of button D sent by remote control B. Then, remote control A may set key value information of button D to the key value information of button C according to a correspondence of key value information between button C and button D, so that the operator can implement information input to an electronic device corresponding to remote control B by performing an operation on button C on remote control A rather than performing an operation on button D on remote control B.

However, because operations need to be simultaneously performed on two remote controls, decreases in operation efficiency and operation reliability are caused.

SUMMARY

According to multiple aspects of the present application, a method for processing key value information of a remote control, a control device, and a remote control are provided, so as to improve operation efficiency and operation reliability.

According to one aspect of the present application, a method for processing key value information of a remote control is provided, including sending a display instruction to a display device, where the display instruction is used to instruct the display device to display a to-be-learned first button on a first remote control; receiving indication information sent by the first remote control, where the indication information is sent by the first remote control after key value information, which is sent by a second remote control, of a second button on the second remote control is received, where the key value information of the second button is information triggered by an operator by pressing the second button that corresponds to the first button displayed by the display device, and the indication information is used to indicate a status that the key value information of the second button is received; and sending an identifier of the first button to the first remote control according to the indication information, so that the first remote control obtains a correspondence of key value information between the first button and the second button according to the identifier of the first button, and sets key value information of the first button to the key value information of the second button.

With reference to the foregoing aspect, an implementation manner is further provided, where the indication information is acknowledgement information used to indicate that the key value information of the second button has been received; and the method further includes establishing, by the first remote control, the correspondence of key value information between the first button and the second button according to the identifier of the first button and the key value information of the second button.

With reference to the foregoing aspect or any possible implementation manner, an implementation manner is further provided, where the indication information is the key value information of the second button; and the method further includes establishing the correspondence of key value information between the first button and the second button according to the identifier of the first button and the indication information; and sending the correspondence to the first remote control, where the correspondence includes the identifier of the first button and the key value information of the second button, so that the first remote control obtains the correspondence according to the identifier of the first button; or establishing, by the first remote control, the correspondence of key value information between the first button and the second button according to the identifier of the first button and the key value information of the second button.

With reference to the foregoing aspect or any possible implementation manner, an implementation manner is further provided, where the receiving, by the first remote control, the key value information of the second button sent by the second remote control includes receiving, by the first remote control in a wired or wireless manner, the key value information of the second button sent by the second remote control.

With reference to the foregoing aspect or any possible implementation manner, an implementation manner is further provided, where the receiving indication information sent by the first remote control includes receiving, in a wired or wireless manner, the indication information sent by the first remote control.

With reference to the foregoing aspect or any possible implementation manner, an implementation manner is further provided, where the sending an identifier of the first button to the first remote control according to the indication information includes sending the identifier of the first button to the first remote control in a wired or wireless manner according to the indication information.

According to another aspect of the present application, a method for processing key value information of a remote control is provided, including receiving key value information, which is sent by a second remote control, of a second button on the second remote control, where the key value information of the second button is information triggered by an operator by pressing the second button that corresponds to the first button displayed by a display device, where the first button displayed by the display device is a display instruction sent by a control device and received by the display device, where the display instruction is used to instruct the display device to display the first button; sending indication information to the control device, where the indication information is used to indicate a status that the key value information of the second button is received; receiving an identifier of the first button that is sent by the control device according to the indication information; obtaining a correspondence of key value information between the first button and the second button according to the identifier of the first button; and setting key value information of the first button to the key value information of the second button according to the correspondence.

With reference to the foregoing aspect or any possible implementation manner, an implementation manner is further provided, where the indication information is acknowledgement information used to indicate that the key value information of the second button has been received; and the method further includes establishing the correspondence of key value information between the first button and the second button according to the identifier of the first button and the key value information of the second button.

With reference to the foregoing aspect or any possible implementation manner, an implementation manner is further provided, where the indication information is the key value information of the second button; and the method further includes establishing the correspondence of key value information between the first button and the second button according to the identifier of the first button and the key value information of the second button; or receiving the correspondence, which is sent by the control device, of key value information between the first button and the second button, where the correspondence includes the identifier of the first button and the key value information of the second button, and the correspondence is established by the control device according to the identifier of the first button and the indication information.

With reference to the foregoing aspect or any possible implementation manner, an implementation manner is further provided, where the receiving key value information, which is sent by a second remote control, of a second button on the second remote control includes receiving, in a wired or wireless manner, the key value information of the second button sent by the second remote control.

With reference to the foregoing aspect and any possible implementation manner, an implementation manner is further provided, where the sending the indication information to the control device includes sending the indication information to the control device in a wired or wireless manner.

With reference to the foregoing aspect or any possible implementation manner, an implementation manner is further provided, where the receiving an identifier of the first button that is sent by the control device according to the indication information includes receiving, in a wired or wireless manner, the identifier of the first button that is sent by the control device according to the indication information.

According to another aspect of the present application, a control device is provided, including a sending unit configured to send a display instruction to a display device, where the display instruction is used to instruct the display device to display a to-be-learned first button on a first remote control; and a receiving unit configured to receive indication information sent by the first remote control, and transmit the indication information to the sending unit, where the indication information is sent by the first remote control after key value information, which is sent by a second remote control, of a second button on the second remote control is received, where the key value information of the second button is information triggered by an operator by pressing the second button that corresponds to the first button displayed by the display device, and the indication information is used to indicate a status that the key value information of the second button is received; where the sending unit is further configured to send an identifier of the first button to the first remote control according to the indication information, so that the first remote control obtains a correspondence of key value information between the first button and the second button according to the identifier of the first button, and sets key value information of the first button to the key value information of the second button according to the correspondence.

With reference to the foregoing aspect or any possible implementation manner, an implementation manner is further provided, where the indication information is acknowledgement information used to indicate that the key value information of the second button has been received.

With reference to the foregoing aspect or any possible implementation manner, an implementation manner is further provided, where the indication information is the key value information of the second button; the control device further includes an establishing unit configured to establish the correspondence of key value information between the first button and the second button according to the identifier of the first button and the indication information, and transmit the correspondence to the sending unit; and the sending unit is further configured to send the correspondence to the first remote control, where the correspondence includes the identifier of the first button and the key value information of the second button, so that the first remote control obtains the correspondence according to the identifier of the first button.

With reference to the foregoing aspect or any possible implementation manner, an implementation manner is further provided, where the receiving unit is configured to receive, in a wired or wireless manner, the indication information sent by the first remote control.

With reference to the foregoing aspect or any possible implementation manner, an implementation manner is further provided, where the sending unit is configured to send the identifier of the first button to the first remote control in a wired or wireless manner according to the indication information.

According to another aspect of the present application, a remote control is provided, including a receiving unit configured to receive key value information, which is sent by a second remote control, of a second button on the second remote control, where the key value information of the second button is information triggered by an operator by pressing the second button that corresponds to the first button displayed by a display device, where the first button displayed by the display device is a display instruction sent by a control device and received by the display device, where the display instruction is used to instruct the display device to display the first button; a sending unit configured to send indication information to the control device, where the indication information is used to indicate a status that the key value information of the second button is received by the receiving unit; where the receiving unit is further configured to receive an identifier of the first button that is sent by the control device according to the indication information, and transmit the identifier of the first button to the obtaining unit; the obtaining unit configured to obtain a correspondence of key value information between the first button and the second button according to the identifier of the first button, and transmit the correspondence to a setting unit; and the setting unit configured to set key value information of the first button to the key value information of the second button according to the correspondence.

With reference to the foregoing aspect or any possible implementation manner, an implementation manner is further provided, where the indication information is acknowledgement information used to indicate that the key value information of the second button has been received; and the remote control further includes a first establishing unit configured to establish the correspondence of key value information between the first button and the second button according to the identifier of the first button and the key value information of the second button.

With reference to the foregoing aspect or any possible implementation manner, an implementation manner is further provided, where the indication information is the key value information of the second button; and the remote control further includes a second establishing unit configured to establish the correspondence of key value information between the first button and the second button according to the identifier of the first button and the key value information of the second button; or the receiving unit is further configured to receive the correspondence, which is sent by the control device, of key value information between the first button and the second button, where the correspondence includes the identifier of the first button and the key value information of the second button, and the correspondence is established by the control device according to the identifier of the first button and the indication information.

With reference to the foregoing aspect or any possible implementation manner, an implementation manner is further provided, where the receiving unit is configured to receive, in a wired or wireless manner, the key value information of the second button sent by the second remote control.

With reference to the foregoing aspect and any possible implementation manner, an implementation manner is further provided, where the sending unit is configured to send the indication information to the control device in a wired or wireless manner.

With reference to the foregoing aspect or any possible implementation manner, an implementation manner is further provided, where the receiving unit is configured to receive, in a wired or wireless manner, the identifier of the first button that is sent by the control device according to the indication information.

According to another aspect of the present application, a control device is provided, including a communications interface, a memory, and at least one processor, where the communications interface is configured to send a display instruction to a display device, where the display instruction is used to instruct the display device to display a to-be-learned first button on a first remote control; the communications interface is further configured to receive indication information sent by the first remote control, where the indication information is sent by the first remote control after key value information, which is sent by a second remote control, of a second button on the second remote control is received, where the key value information of the second button is information triggered by an operator by pressing the second button that corresponds to the first button displayed by the display device, and the indication information is used to indicate a status that the key value information of the second button is received; the communications interface is further configured to send an identifier of the first button to the first remote control according to the indication information, so that the first remote control obtains a correspondence of key value information between the first button and the second button according to the identifier of the first button, and sets key value information of the first button to the key value information of the second button according to the correspondence; the memory stores executable program code; and the processor runs a program corresponding to the executable program code by reading the executable program code stored in the memory, so as to implement a control function of the control device.

With reference to the foregoing aspect or any possible implementation manner, an implementation manner is further provided, where the indication information is acknowledgement information used to indicate that the key value information of the second button has been received.

With reference to the foregoing aspect or any possible implementation manner, an implementation manner is further provided, where the indication information is the key value information of the second button; the processor is further configured to establish the correspondence of key value information between the first button and the second button according to the identifier of the first button and the indication information, and transmit the correspondence to the communications interface; and the communications interface is further configured to send the correspondence to the first remote control, where the correspondence includes the identifier of the first button and the key value information of the second button, so that the first remote control obtains the correspondence according to the identifier of the first button.

With reference to the foregoing aspect or any possible implementation manner, an implementation manner is further provided, where the communications interface is configured to receive, in a wired or wireless manner, the indication information sent by the first remote control.

With reference to the foregoing aspect or any possible implementation manner, an implementation manner is further provided, where the communications interface is configured to send the identifier of the first button to the first remote control in a wired or wireless manner according to the indication information.

According to another aspect of the present application, a remote control is provided, including a communications interface, a memory, and at least one processor, where the communications interface is configured to receive key value information, which is sent by a second remote control, of a second button on the second remote control, where the key value information of the second button is information triggered by an operator by pressing the second button that corresponds to the first button displayed by a display device, where first button displayed by the display device is a display instruction sent by a control device and received by the display device, where the display instruction is used to instruct the display device to display the first button; the communications interface is further configured to send indication information to the control device, where the indication information is used to indicate a status that the key value information of the second button is received; the communications interface is further configured to receive an identifier of the first button that is sent by the control device according to the indication information; the memory is configured to store executable program code; and the processor runs a program corresponding to the executable program code by reading the executable program code stored in the memory, so as to obtain a correspondence of key value information between the first button and the second button according to the identifier of the first button; and set key value information of the first button to the key value information of the second button according to the correspondence.

With reference to the foregoing aspect or any possible implementation manner, an implementation manner is further provided, where the indication information is acknowledgement information used to indicate that the key value information of the second button has been received; and the processor is further configured to establish the correspondence of key value information between the first button and the second button according to the identifier of the first button and the key value information of the second button.

With reference to the foregoing aspect or any possible implementation manner, an implementation manner is further provided, where the indication information is the key value information of the second button; and the processor is further configured to establish the correspondence of key value information between the first button and the second button according to the identifier of the first button and the key value information of the second button; or the communications interface is further configured to receive the correspondence, which is sent by the control device, of key value information between the first button and the second button, where the correspondence includes the identifier of the first button and the key value information of the second button, and the correspondence is established by the control device according to the identifier of the first button and the indication information.

According to the foregoing technical solutions, a display instruction is sent to a display device, where the display instruction is used to instruct the display device to display a to-be-learned first button on a first remote control; and further, indication information sent by the first remote control is received, where the indication information is sent by the first remote control after key value information, which is sent by a second remote control, of a second button on the second remote control is received, where the key value information of the second button is information triggered by an operator by pressing the second button that corresponds to the first button displayed by the display device, and the indication information is used to indicate a status that the key value information of the second button is received, so that an identifier of the first button can be sent to the first remote control according to the indication information, so that the first remote control obtains a correspondence of key value information between the first button and the second button according to the identifier of the first button, and sets key value information of the first button to the key value information of the second button according to the correspondence. It can be implemented that another remote control is synchronously set by performing operations on one remote control and displaying, by using a display device, a to-be-learned button on the another remote control, which is easy to operate and thereby improves operation efficiency and operation reliability.

BRIEF DESCRIPTION OF THE DRAWINGS

To describe the technical solutions in the embodiments of the present application more clearly, the following briefly introduces the accompanying drawings required for describing the embodiments. The accompanying drawings in the following description show some embodiments of the present application, and a person of ordinary skill in the art may still derive other drawings from these accompanying drawings without creative efforts.

DETAILED DESCRIPTION

To make the objectives, technical solutions, and advantages of the embodiments of the present application clearer, the following clearly describes the technical solutions in the embodiments of the present application with reference to the accompanying drawings in the embodiments of the present application. The described embodiments are merely some but not all of the embodiments of the present application. All other embodiments obtained by a person of ordinary skill in the art based on the embodiments of the present application without creative efforts shall fall within the protection scope of the present application.

In addition, the term "and/or" in this specification describes only an association relationship for describing associated objects and represents that three relationships may exist. For example, A and/or B may represent the following three cases: only A exists, both A and B exist, and only B exists. In addition, the character "/" in this specification generally indicates an "or" relationship between the associated objects.

Figure 1:
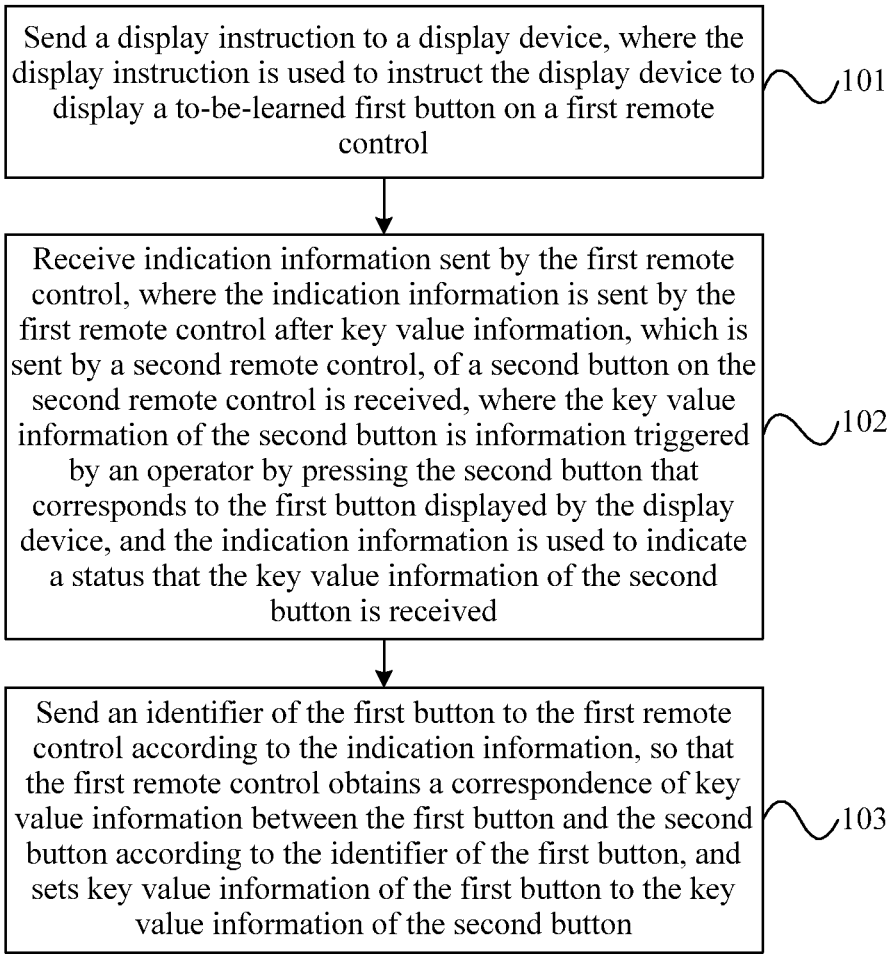
FIG. 1 is a schematic flowchart of a method for processing key value information of a remote control according to an embodiment of the present application.

FIG. 1 is a schematic flowchart of a method for processing key value information of a remote control according to an embodiment of the present application, as shown in FIG. 1.

101. Send a display instruction to a display device, where the display instruction is used to instruct the display device to display a to-be-learned first button on a first remote control.

102. Receive indication information sent by the first remote control, where the indication information is sent by the first remote control after key value information, which is sent by a second remote control, of a second button on the second remote control is received, where the key value information of the second button is information triggered by an operator by pressing the second button that corresponds to the first button displayed by the display device, and the indication information is used to indicate a status that the key value information of the second button is received.

103. Send an identifier of the first button to the first remote control according to the indication information, so that the first remote control obtains a correspondence of key value information between the first button and the second button according to the identifier of the first button, and sets key value information of the first button to the key value information of the second button.

It should be noted that 101 to 103 may be performed by a control device, which may be a terminal device, where the terminal device separately establishes a communication connection with the first remote control, the second remote control, and the display device.

Optionally, in a possible implementation manner of this embodiment, the indication information may be acknowledgement information used to indicate that the key value information of the second button has been received. Correspondingly, the first remote control may further establish the correspondence of key value information between the first button and the second button according to the identifier of the first button and the key value information of the second button.

Optionally, in a possible implementation manner of this embodiment, the indication information may also be the key value information of the second button.

Correspondingly, the control device may further establish the correspondence of key value information between the first button and the second button according to the identifier of the first button and the indication information; and send the correspondence to the first remote control, where the correspondence includes the identifier of the first button and the key value information of the second button, so that the first remote control obtains the correspondence according to the identifier of the first button.

Correspondingly, the first remote control may further establish the correspondence of key value information between the first button and the second button according to the identifier of the first button and the key value information of the second button.

Optionally, in a possible implementation manner of this embodiment, in 102, the first remote control may receive, in a wired or wireless manner, the key value information of the second button sent by the second remote control.

Optionally, in a possible implementation manner of this embodiment, in 102, the control device may receive, in a wired or wireless manner, the indication information sent by the first remote control.

Optionally, in a possible implementation manner of this embodiment, in 103, the control device may send the identifier of the first button to the first remote control in a wired or wireless manner according to the indication information.

The wired manner may include but is not limited to a personal system 2 (PS2) interface manner or a universal serial bus (USB) interface manner.

The wireless manner may include but is not limited to an infrared manner, a Bluetooth® manner, a radio frequency manner, or a wireless fidelity (WiFi) manner.

It should be noted that the technical solution provided by this embodiment may be used to set key value information of corresponding first buttons one by one correspondingly for every second button on the second remote control and key value information of every second button. The control device may send a display instruction to the display device, where the display instruction is used to instruct the display device to highlight, in a first specified color (for example, green), one to-be-learned first button on the first remote control. Correspondingly, after the first remote control has set key value information of the first button, the control device may further send another display instruction to the display device, where the another display instruction is used to instruct the display device to highlight the first button in a second specified color (for example, red) different from the first specified color, so as to indicate that the first button has been set. Then, the control device repeats 101 to 103, so that the first remote control sets the key value information of the corresponding first buttons one by one.

It should be noted that the technical solution provided by this embodiment may be further used to uniformly set key value information of corresponding first buttons correspondingly for every second button on the second remote control and key value information of every second button. The control device may send a display instruction to the display device, where the display instruction is used to instruct the display device to highlight, in a first specified color (for example, green), one to-be-learned first button on the first remote control. Correspondingly, after sending the identifier of the first button to the first remote control, the control device may further send another display instruction to the display device, where the another display instruction is used to instruct the display device to highlight the first button in a second specified color (for example, red) different from the first specified color, so as to indicate that the first button is subsequently to be uniformly set. Then, the control device repeats 101 to 103 until the first remote control obtains a correspondence that includes key value information of every second button on the second remote control, so that the first remote control may uniformly set key value information of corresponding first buttons according to the correspondence.

In this embodiment, a display instruction is sent to a display device, where the display instruction is used to instruct the display device to display a to-be-learned first button on a first remote control; and further, indication information sent by the first remote control is received, where the indication information is sent by the first remote control after key value information, which is sent by a second remote control, of a second button on the second remote control is received, where the key value information of the second button is information triggered by an operator by pressing the second button that corresponds to the first button displayed by the display device, and the indication information is used to indicate a status that the key value information of the second button is received, so that an identifier of the first button can be sent to the first remote control according to the indication information, so that the first remote control obtains a correspondence of key value information between the first button and the second button according to the identifier of the first button, and sets key value information of the first button to the key value information of the second button according to the correspondence. A problem, in the prior art, of reduced operation efficiency and reduced operation reliability caused by the need of simultaneous operations on two remote controls can be avoided. By using the technical solution provided by this embodiment of the present invention, it can be implemented that another remote control is synchronously set by performing operations on one remote control and displaying, by using a display device, a to-be-learned button on the another remote control, which is easy to operate and thereby improves operation efficiency and operation reliability.

Figure 2:
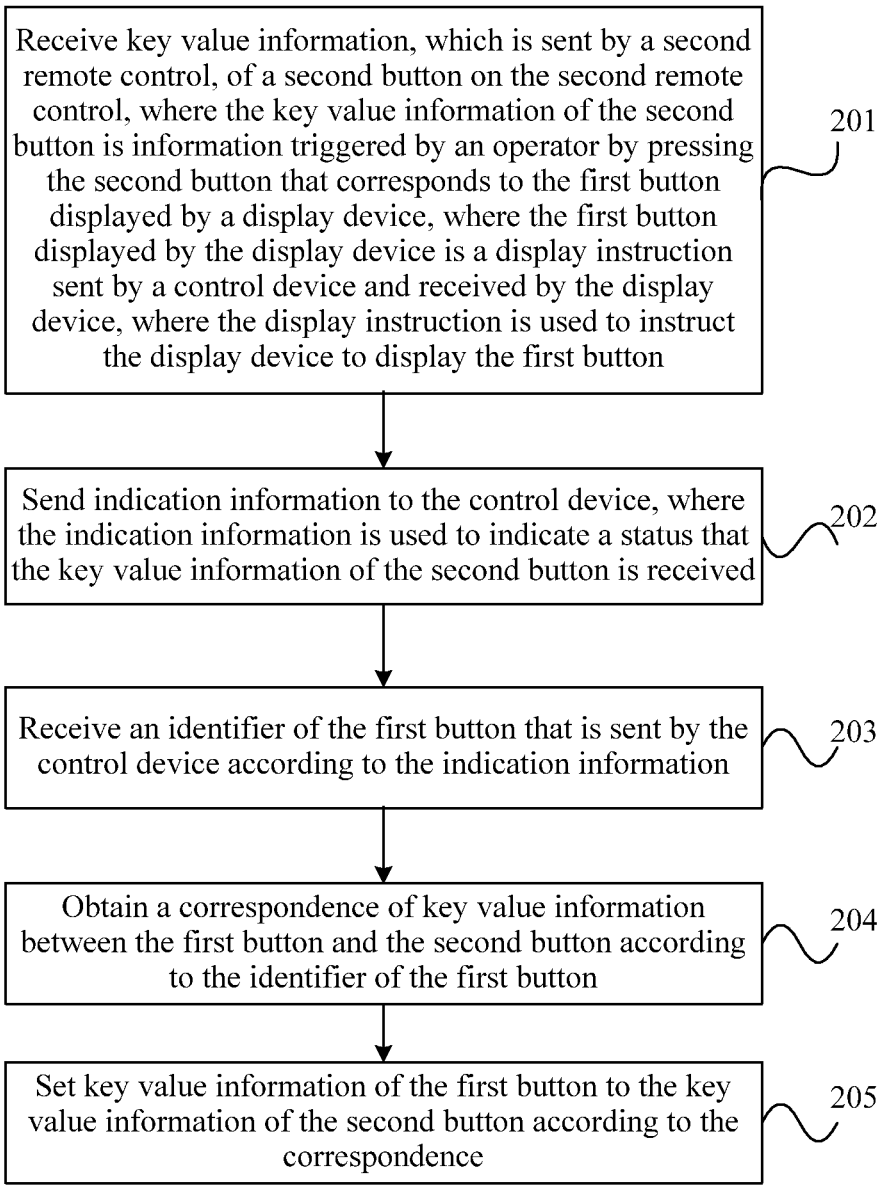
FIG. 2 is a schematic flowchart of a method for processing key value information of a remote control according to another embodiment of the present application.

FIG. 2 is a schematic flowchart of a method for processing key value information of a remote control according to another embodiment of the present application, as shown in FIG. 2.

201. Receive key value information, which is sent by a second remote control, of a second button on the second remote control, where the key value information of the second button is information triggered by an operator by pressing the second button that corresponds to a first button displayed by a display device, where the first button displayed by the display device is a display instruction sent by a control device and received by the display device, where the display instruction is used to instruct the display device to display the first button.

202. Send indication information to the control device, where the indication information is used to indicate a status that the key value information of the second button is received.

203. Receive an identifier of the first button that is sent by the control device according to the indication information.

204. Obtain a correspondence of key value information between the first button and the second button according to the identifier of the first button.

205. Set key value information of the first button to the key value information of the second button according to the correspondence.

It should be noted that 201 to 205 may be performed by a first remote control. The control device may be a terminal device, where the terminal device separately establishes a communication connection with the first remote control, the second remote control, and the display device.

Optionally, in a possible implementation manner of this embodiment, the indication information may be acknowledgement information used to indicate that the key value information of the second button has been received. Correspondingly, the first remote control may further establish the correspondence of key value information between the first button and the second button according to the identifier of the first button and the key value information of the second button.

Optionally, in a possible implementation manner of this embodiment, the indication information may also be the key value information of the second button.

Correspondingly, the first remote control may further establish the correspondence of key value information between the first button and the second button according to the identifier of the first button and the key value information of the second button.

Correspondingly, the first remote control may further receive the correspondence, which is sent by the control device, of key value information between the first button and the second button, where the correspondence includes the identifier of the first button and the key value information of the second button, and the correspondence is established by the control device according to the identifier of the first button and the indication information.

Optionally, in a possible implementation manner of this embodiment, in 201, the first remote control may receive, in a wired or wireless manner, the key value information of the second button sent by the second remote control.

Optionally, in a possible implementation manner of this embodiment, in 202, the first remote control may send the indication information to the control device in a wired or wireless manner.

Optionally, in a possible implementation manner of this embodiment, in 203, the first remote control may receive, in a wired or wireless manner, the identifier of the first button that is sent by the control device, according to the indication information.

The wired manner may include but is not limited to a PS2 interface manner or a USB interface manner.

The wireless manner may include but is not limited to an infrared manner, a Bluetooth® manner, a radio frequency manner, or a WiFi manner.

It should be noted that the technical solution provided by this embodiment may be used to set key value information of corresponding first buttons one by one correspondingly for every second button on the second remote control and key value information of every second button. The control device may send a display instruction to the display device, where the display instruction is used to instruct the display device to highlight, in a first specified color (for example, green), one to-be-learned first button on the first remote control. Correspondingly, after the first remote control has set key value information of the first button, the control device may further send another display instruction to the display device, where the another display instruction is used to instruct the display device to highlight the first button in a second specified color (for example, red) different from the first specified color, so as to indicate that the first button has been set. Then, the first remote control repeats 201 to 205 to set key value information of corresponding first buttons one by one.

It should be noted that the technical solution provided by this embodiment may be further used to uniformly set key value information of corresponding first buttons correspondingly for to every second button on the second remote control and key value information of every second button. The control device may send a display instruction to the display device, where the display instruction is used to instruct the display device to highlight, in a first specified color (for example, green), one to-be-learned first button on the first remote control. Correspondingly, after sending the identifier of the first button to the first remote control, the control device may further send another display instruction to the display device, where the another display instruction is used to instruct the display device to highlight the first button in a second specified color (for example, red) different from the first specified color, so as to indicate that the first button is subsequently to be uniformly set. Then, the first remote control repeats 201 to 204 until the first remote control obtains the correspondence that includes key value information of every second button on the second remote control, and then the first remote control may perform 205, that is, uniformly set key value information of corresponding first buttons according to the correspondence.

In this embodiment, key value information, which is sent by a second remote control, of a second button on the second remote control is received, where the key value information of the second button is information triggered by an operator by pressing the second button that corresponds to a first button displayed by a display device, where the first button displayed by the display device is a display instruction sent by a control device and received by the display device, where the display instruction is used to instruct the display device to display the first button; and further, indication information is sent to the control device, where the indication information is used to indicate a status that the key value information of the second button is received, so that an identifier of the first button that is sent by the control device according to the indication information can be received, and a correspondence of key value information between the first button and the second button is obtained according to the identifier of the first button, so as to set the key value information of the first button to the key value information of the second button according to the correspondence. A problem, in the prior art, of reduced operation efficiency and reduced operation reliability caused by the need of simultaneous operations on two remote controls can be avoided. By using the technical solution provided by this embodiment of the present invention, it can be implemented that another remote control is synchronously set by performing operations on one remote control and displaying, by using a display device, a to-be-learned button on the another remote control, which is easy to operate and thereby improves operation efficiency and operation reliability.

It should be noted that, for brief description, the foregoing method embodiments are represented as series of actions. However, a person skilled in the art should appreciate that the present application is not limited to the described order of the actions, because according to the present application, some steps may be performed in other order or simultaneously. It should be further appreciated by a person skilled in the art that the embodiments described in this specification are all exemplary embodiments, and the involved actions and modules are not necessarily required by the present application.

In the foregoing embodiments, the description of every embodiment has respective focuses. For a part that is not described in detail in one embodiment, reference may be made to related descriptions in other embodiments.

Figure 3:
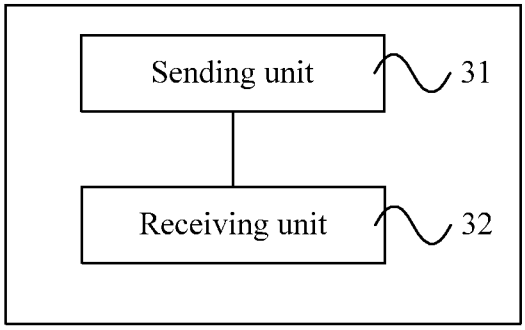
FIG. 3 is a schematic structural diagram of a control device according to another embodiment of the present application.

FIG. 3 is a schematic structural diagram of a control device according to another embodiment of the present application. As shown in FIG. 3, the control device according to this embodiment may include a sending unit 31 and a receiving unit 32. The sending unit 31 is configured to send a display instruction to a display device, where the display instruction is used to instruct the display device to display a to-be-learned first button on a first remote control. The receiving unit 32 is configured to receive indication information sent by the first remote control, and transmit the indication information to the sending unit 31, where the indication information is sent by the first remote control after key value information, which is sent by a second remote control, of a second button on the second remote control is received, where the key value information of the second button is information triggered by an operator by pressing the second button that corresponds to the first button displayed by the display device, and the indication information is used to indicate a status that the key value information of the second button is received. The sending unit 31 is further configured to send an identifier of the first button to the first remote control according to the indication information, so that the first remote control obtains a correspondence of key value information between the first button and the second button according to the identifier of the first button, and sets key value information of the first button to the key value information of the second button according to the correspondence.

It should be noted that the control device provided by this embodiment may be a terminal device, where the terminal device separately establishes a communication connection with the first remote control, the second remote control, and the display device.

Optionally, in a possible implementation manner of this embodiment, the indication information may be acknowledgement information used to indicate that the key value information of the second button has been received. Correspondingly, the first remote control may further establish the correspondence of key value information between the first button and the second button according to the identifier of the first button and the key value information of the second button.

Optionally, in a possible implementation manner of this embodiment, the indication information may also be the key value information of the second button.

Figure 4:
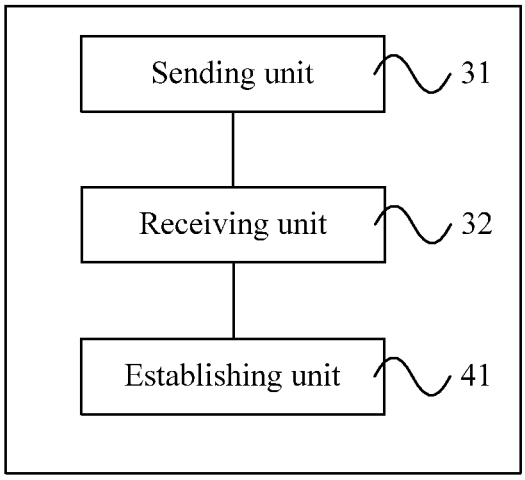
FIG. 4 is a schematic structural diagram of a control device according to another embodiment of the present application.

Correspondingly, as shown in FIG. 4, the control device may further include an establishing unit 41 configured to establish the correspondence of key value information between the first button and the second button according to the identifier of the first button and the indication information, and transmit the correspondence to the sending unit 31; and the sending unit 31 is further configured to send the correspondence to the first remote control, where the correspondence includes the identifier of the first button and the key value information of the second button, so that the first remote control obtains the correspondence according to the identifier of the first button.

Correspondingly, the first remote control may further establish the correspondence of key value information between the first button and the second button according to the identifier of the first button and the key value information of the second button.

Optionally, in a possible implementation manner of this embodiment, the receiving unit 32 may be configured to receive, in a wired or wireless manner, the indication information sent by the first remote control.

Optionally, in a possible implementation manner of this embodiment, the sending unit 31 may be configured to send the identifier of the first button to the first remote control in a wired or wireless manner according to the indication information.

The wired manner may include but is not limited to a PS2 interface manner or a USB interface manner.

The wireless manner may include but is not limited to an infrared manner, a Bluetooth® manner, a radio frequency manner, or a WiFi manner.

It should be noted that the technical solution provided by this embodiment may be used to set key value information of corresponding first buttons one by one correspondingly for every second button on the second remote control and key value information of every second button. The sending unit 31 may send a display instruction to the display device, where the display instruction is used to instruct the display device to highlight, in a first specified color (for example, green), one to-be-learned first button on the first remote control. Correspondingly, after the first remote control has set key value information of the first button, the control device may further send another display instruction to the display device, where the another display instruction is used to instruct the display device to highlight the first button in a second specified color (for example, red) different from the first specified color, so as to indicate that the first button has been set. Then, the sending unit 31 and the receiving unit 32 repeat their respective operations, so that the first remote control set key value information of corresponding first buttons one by one.

It should be noted that the technical solution provided by this embodiment may be further used to uniformly set key value information of corresponding first buttons correspondingly for every second button on the second remote control and key value information of every second button. The sending unit 31 may send a display instruction to the display device, where the display instruction is used to instruct the display device to highlight, in a first specified color (for example, green), one to-be-learned first button on the first remote control. Correspondingly, after the control device sends the identifier of the first button to the first remote control, the control device may further send another display instruction to the display device, where the another display instruction is used to instruct the display device to highlight the first button in a second specified color (for example, red) different from the first specified color, so as to indicate that the first button is subsequently to be uniformly set. Then, the sending unit 31 and the receiving unit 32 repeat their respective operations until the first remote control obtains a correspondence that includes key value information of every second button on the second remote control, so that the first remote control may uniformly set key value information of corresponding first buttons according to the correspondence.

In this embodiment, a control device sends, by using a sending unit, a display instruction to a display device, where the display instruction is used to instruct the display device to display a to-be-learned first button on a first remote control; and further, a receiving unit receives indication information sent by the first remote control, where the indication information is sent by the first remote control after key value information, which is sent by a second remote control, of a second button on the second remote control is received, where the key value information of the second button is information triggered by an operator by pressing the second button that corresponds to the first button displayed by the display device, and the indication information is used to indicate a status that the key value information of the second button is received, so that the sending unit can send an identifier of the first button to the first remote control according to the indication information, so that the first remote control obtains a correspondence of key value information between the first button and the second button according to the identifier of the first button, and sets key value information of the first button to the key value information of the second button according to the correspondence. A problem, in the prior art, of reduced operation efficiency and reduced operation reliability caused by the need of simultaneous operations on two remote controls can be avoided. By using the technical solution provided by this embodiment of the present invention, it can be implemented that another remote control is synchronously set by performing operations on one remote control and displaying, by using a display device, a to-be-learned button on the another remote control, which is easy to operate and thereby improves operation efficiency and operation reliability.

Figure 5:
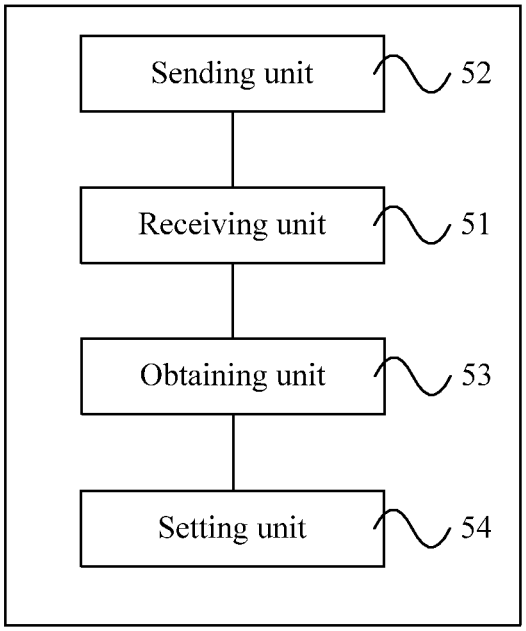
FIG. 5 is a schematic structural diagram of a remote control according to another embodiment of the present application.

FIG. 5 is a schematic structural diagram of a remote control according to another embodiment of the present application. As shown in FIG. 5, the remote control according to this embodiment may include a receiving unit 51, a sending unit 52, an obtaining unit 53, and a setting unit 54. The receiving unit 51 is configured to receive key value information, which is sent by a second remote control, of a second button on the second remote control, where the key value information of the second button is information triggered by an operator by pressing the second button that corresponds to a first button displayed by a display device, where the first button displayed by the display device is a display instruction sent by a control device and received by the display device, where the display instruction is used to instruct the display device to display the first button. The sending unit 52 is configured to send indication information to the control device, where the indication information is used to indicate a status that the key value information of the second button is received by the receiving unit 51. The receiving unit 51 is further configured to receive an identifier of the first button that is sent by the control device according to the indication information, and transmit the identifier of the first button to the obtaining unit 53. The obtaining unit 53 is configured to obtain a correspondence of key value information between the first button and the second button according to the identifier of the first button, and transmit the correspondence to a setting unit 54. The setting unit 54 is configured to set key value information of the first button to the key value information of the second button according to the correspondence.

It should be noted that the control device may be a terminal device, where the terminal device separately establishes a communication connection with the remote control, the second remote control, and the display device.

Figure 6:
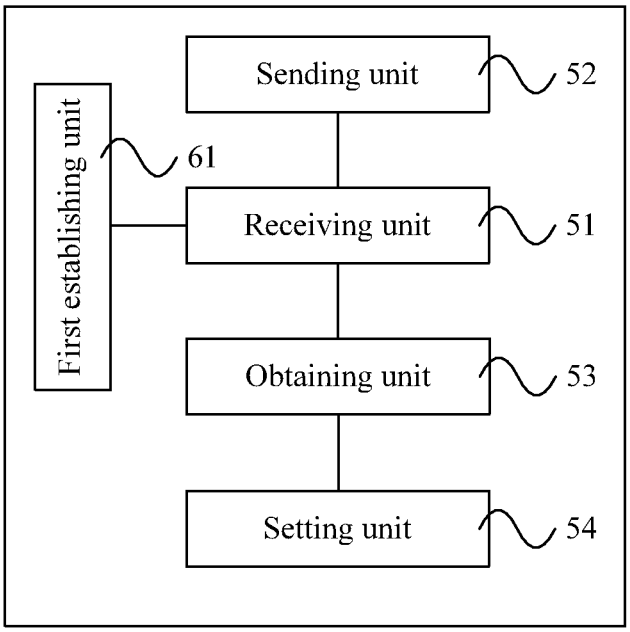
FIG. 6 is a schematic structural diagram of a remote control according to another embodiment of the present application.

Optionally, in a possible implementation manner of this embodiment, the indication information may be acknowledgement information used to indicate that the key value information of the second button has been received. Correspondingly, as shown in FIG. 6, the remote control may further include a first establishing unit 61 configured to establish the correspondence of key value information between the first button and the second button according to the identifier of the first button and the key value information of the second button.

Optionally, in a possible implementation manner of this embodiment, the indication information may also be the key value information of the second button.

Figure 7:
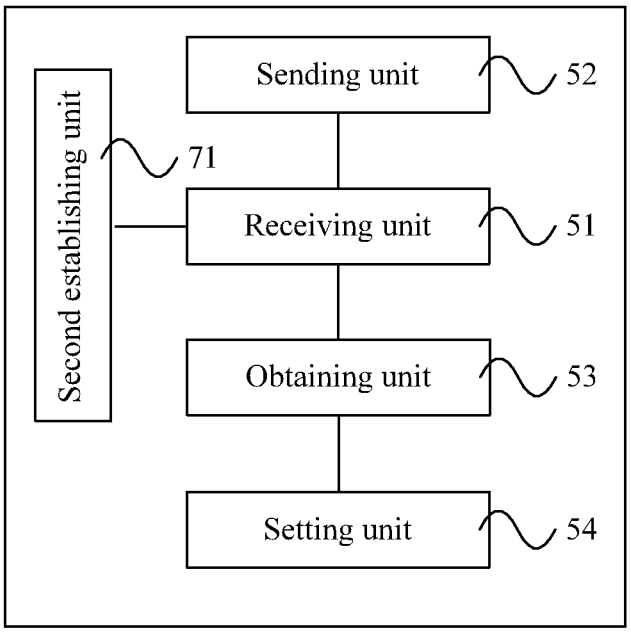
FIG. 7 is a schematic structural diagram of a remote control according to another embodiment of the present application.

Correspondingly, as shown in FIG. 7, the remote control according to this embodiment may further include a second establishing unit 71 configured to establish the correspondence of key value information between the first button and the second button according to the identifier of the first button and the key value information of the second button.

Correspondingly, the receiving unit 51 may be further configured to receive the correspondence, which is sent by the control device, of key value information between the first button and the second button, where the correspondence includes the identifier of the first button and the key value information of the second button, and the correspondence is established by the control device according to the identifier of the first button and the indication information.

Optionally, in a possible implementation manner of this embodiment, the receiving unit 51 may be configured to receive, in a wired or wireless manner, the key value information of the second button sent by the second remote control.

Optionally, in a possible implementation manner of this embodiment, the sending unit 52 may be configured to send the indication information to the control device in a wired or wireless manner.

Optionally, in a possible implementation manner of this embodiment, the receiving unit 51 may be configured to receive, in a wired or wireless manner, the identifier of the first button that is sent by the control device according to the indication information.

The wired manner may include but is not limited to a PS2 interface manner or a USB interface manner.

The wireless manner may include but is not limited to an infrared manner, a Bluetooth® manner, a radio frequency manner, or a WiFi manner.

It should be noted that the technical solution provided by this embodiment may be used to set key value information of corresponding first buttons one by one correspondingly for every second button on the second remote control and key value information of every second button. The control device may send a display instruction to the display device, where the display instruction is used to instruct the display device to highlight, in a first specified color (for example, green), one to-be-learned first button on the first remote control. Correspondingly, after the setting unit 54 has set the key value information of the first button, the control device may further send another display instruction to the display device, where the another display instruction is used to instruct the display device to highlight the first button in a second specified color (for example, red) different from the first specified color, so as to indicate that the first button has been set. Then, the receiving unit 51, the sending unit 52, the obtaining unit 53, and the setting unit 54 repeat their respective operations, so as to set key value information of corresponding first buttons one by one.

It should be noted that the technical solution provided by this embodiment may be further used to uniformly set key value information of corresponding first buttons correspondingly for every second button on the second remote control and key value information of every second button. The control device may send a display instruction to the display device, where the display instruction is used to instruct the display device to highlight, in a first specified color (for example, green), one to-be-learned first button on the first remote control. Correspondingly, after sending the identifier of the first button to the first remote control, the control device may further send another display instruction to the display device, where the another display instruction is used to instruct the display device to highlight the first button in a second specified color (for example, red) different from the first specified color, so as to indicate that the first button is subsequently to be uniformly set. Then, the receiving unit 51, the sending unit 52, and the obtaining unit 53 repeat their respective operations until the obtaining unit 53 obtains the correspondence that includes key value information of every second button on the second remote control, and then the setting unit 54 may perform an operation, that is, uniformly set key value information of corresponding first buttons according to the correspondence.

In this embodiment, a remote control receives, by using a receiving unit, key value information, which is sent by a second remote control, of a second button on the second remote control, where the key value information of the second button is information triggered by an operator by pressing the second button that corresponds to a first button displayed by a display device, where the first button displayed by the display device is a display instruction sent by a control device and received by the display device, where the display instruction is used to instruct the display device to display the first button; further, a sending unit sends indication information to the control device, where the indication information is used to indicate a status that the key value information of the second button is received, so that the receiving unit can receive an identifier of the first button that is sent by the control device according to the indication information; an obtaining unit obtains a correspondence of key value information between the first button and the second button according to the identifier of the first button, so that a setting unit sets key value information of the first button to the key value information of the second button according to the correspondence. A problem, in the prior art, of reduced operation efficiency and reduced operation reliability caused by the need of simultaneous operations on two remote controls can be avoided. By using the technical solution provided by this embodiment of the present invention, it can be implemented that another remote control is synchronously set by performing operations on one remote control and displaying, by using a display device, a to-be-learned button on the another remote control, which is easy to operate and thereby improves operation efficiency and operation reliability.

Figure 8:
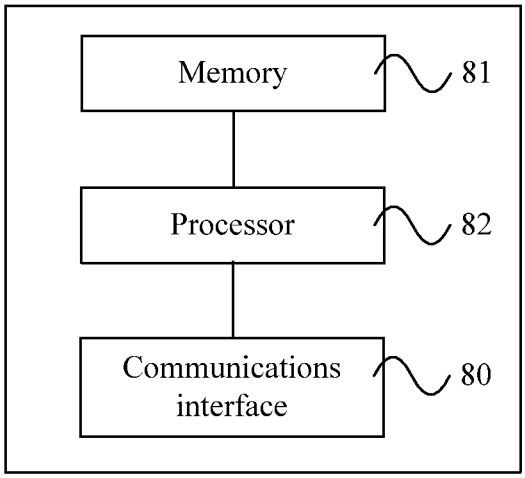
FIG. 8 is a schematic structural diagram of a control device according to another embodiment of the present application.

FIG. 8 is a schematic structural diagram of a control device according to another embodiment of the present application. As shown in FIG. 8, the control device according to this embodiment may include a communications interface 80, a memory 81, and at least one processor 82.

The communications interface 80 is configured to send a display instruction to a display device, where the display instruction is used to instruct the display device to display a to-be-learned first button on a first remote control.

The communications interface 80 is further configured to receive indication information sent by the first remote control, where the indication information is sent by the first remote control after key value information, which is sent by a second remote control, of a second button on the second remote control is received, where the key value information of the second button is information triggered by an operator by pressing the second button that corresponds to the first button displayed by the display device, and the indication information is used to indicate a status that the key value information of the second button is received.

The communications interface 80 is further configured to send an identifier of the first button to the first remote control according to the indication information, so that the first remote control obtains a correspondence of key value information between the first button and the second button according to the identifier of the first button, and sets key value information of the first button to the key value information of the second button according to the correspondence.

The memory 81 is configured to store executable program code. The processor 82 runs a program corresponding to the executable program code by reading the executable program code stored in the memory 81, so as to implement a control function of the control device.

It should be noted that the control device provided by this embodiment may be a terminal device, where the terminal device separately establishes a communication connection with the first remote control, the second remote control, and the display device.

Optionally, in a possible implementation manner of this embodiment, the indication information may be acknowledgement information used to indicate that the key value information of the second button has been received. Correspondingly, the first remote control may further establish the correspondence of key value information between the first button and the second button according to the identifier of the first button and the key value information of the second button.

Optionally, in a possible implementation manner of this embodiment, the indication information may also be the key value information of the second button.

Correspondingly, the processor 82 may be further configured to establish the correspondence of key value information between the first button and the second button according to the identifier of the first button and the indication information, and transmit the correspondence to the communications interface 80. Correspondingly, the communications interface 80 may be further configured to send the correspondence to the first remote control, where the correspondence includes the identifier of the first button and the key value information of the second button, so that the first remote control obtains the correspondence according to the identifier of the first button.

Correspondingly, the first remote control may further establish the correspondence of key value information between the first button and the second button according to the identifier of the first button and the key value information of the second button.

Optionally, in a possible implementation manner of this embodiment, the communications interface 80 may be configured to receive, in a wired or wireless manner, the indication information sent by the first remote control.

Optionally, in a possible implementation manner of this embodiment, the communications interface 80 may be configured to send the identifier of the first button to the first remote control in a wired or wireless manner according to the indication information.

The wired manner may include but is not limited to a PS2 interface manner or a USB interface manner.

The wireless manner may include but is not limited to an infrared manner, a Bluetooth® manner, a radio frequency manner, or a WiFi manner.

It should be noted that the technical solution provided by this embodiment may be used to set key value information of corresponding first buttons one by one correspondingly for every second button on the second remote control and key value information of every second button. The communications interface 80 may send a display instruction to the display device, where the display instruction is used to instruct the display device to highlight, in a first specified color (for example, green), one to-be-learned first button on the first remote control. Correspondingly, after the first remote control has set key value information of the first button, the control device may further send another display instruction to the display device, where the another display instruction is used to instruct the display device to highlight the first button in a second specified color (for example, red) different from the first specified color, so as to indicate that the first button has been set. Then, the communications interface 80 repeats the operation, so that the first remote control sets key value information of corresponding first buttons one by one.

It should be noted that the technical solution provided by this embodiment may be further used to uniformly set key value information of corresponding first buttons correspondingly for every second button on the second remote control and key value information of every second button. The communications interface 80 may send a display instruction to the display device, where the display instruction is used to instruct the display device to highlight, in a first specified color (for example, green), one to-be-learned first button on the first remote control. Correspondingly, after the first remote control sends the identifier of the first button to the first remote control, the control device may further send another display instruction to the display device, where the another display instruction is used to instruct the display device to highlight the first button in a second specified color (for example, red) different from the first specified color, so as to indicate that the first button is subsequently to be uniformly set. Then, the communications interface 80 repeats the operation until the first remote control obtains a correspondence that includes key value information of every second button on the second remote control, so that the first remote control may uniformly set key value information of corresponding first buttons according to the correspondence.

In this embodiment, a control device sends, by using a communications interface, a display instruction to a display device, where the display instruction is used to instruct the display device to display a to-be-learned first button on a first remote control; and further indication information sent by the first remote control is received, where the indication information is sent by the first remote control after key value information, which is sent by a second remote control, of a second button on the second remote control is received, where the key value information of the second button is information triggered by an operator by pressing the second button that corresponds to the first button displayed by the display device, and the indication information is used to indicate a status that the key value information of the second button is received, so that the communications interface can send an identifier of the first button to the first remote control according to the indication information, so that the first remote control obtains a correspondence of key value information between the first button and the second button according to the identifier of the first button, and sets key value information of the first button to the key value information of the second button according to the correspondence. A problem, in the prior art, of reduced operation efficiency and reduced operation reliability caused by the need of simultaneous operations on two remote controls can be avoided. By using the technical solution provided by this embodiment of the present invention, it can be implemented that another remote control is synchronously set by performing operations on one remote control and displaying, by using a display device, a to-be-learned button on the another remote control, which is easy to operate and thereby improves operation efficiency and operation reliability.

Figure 9:
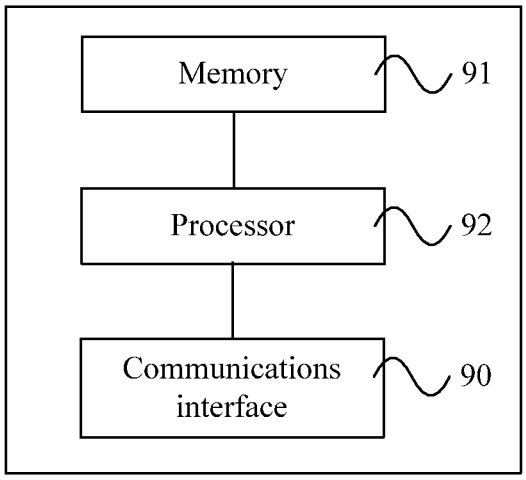
FIG. 9 is a schematic structural diagram of a remote control according to another embodiment of the present application.

FIG. 9 is a schematic structural diagram of a remote control according to another embodiment of the present application. As shown in FIG. 9, the remote control according to this embodiment may include a communications interface 90, a memory 91, and at least one processor 92.

The communications interface 90 is configured to receive key value information, which is sent by a second remote control, of a second button on the second remote control, where the key value information of the second button is information triggered by an operator by pressing the second button that corresponds to a first button displayed by a display device, where the first button displayed by the display device is a display instruction sent by a control device and received by the display device, where the display instruction is used to instruct the display device to display the first button.

The communications interface 90 is further configured to send indication information to the control device, where the indication information is used to indicate a status that the key value information of the second button is received.

The communications interface 90 is further configured to receive an identifier of the first button that is sent by the control device according to the indication information.

The memory 91 is configured to store executable program code. The processor 92 runs a program corresponding to the executable program code by reading the executable program code stored in the memory 91, so as to obtain a correspondence of key value information between the first button and the second button according to the identifier of the first button; and set key value information of the first button to the key value information of the second button according to the correspondence.

It should be noted that, the control device may be a terminal device, where the terminal device separately establishes a communication connection with the remote control, the second remote control, and the display device.

Optionally, in a possible implementation manner of this embodiment, the indication information may be acknowledgement information used to indicate that the key value information of the second button has been received. Correspondingly, the processor 92 may be further configured to establish the correspondence of key value information between the first button and the second button according to the identifier of the first button and the key value information of the second button.

Optionally, in a possible implementation manner of this embodiment, the indication information may also be the key value information of the second button.

Correspondingly, the processor 92 may be further configured to establish the correspondence of key value information between the first button and the second button according to the identifier of the first button and the key value information of the second button.

Correspondingly, the communications interface 90 may be further configured to receive the correspondence, which is sent by the control device, of key value information between the first button and the second button, where the correspondence includes the identifier of the first button and the key value information of the second button, and the correspondence is established by the control device according to the identifier of the first button and the indication information.

Optionally, in a possible implementation manner of this embodiment, the communications interface 90 may be configured to receive, in a wired or wireless manner, the key value information of the second button sent by the second remote control.

Optionally, in a possible implementation manner of this embodiment, the communications interface 90 may be configured to send the indication information to the control device in a wired or wireless manner.

Optionally, in a possible implementation manner of this embodiment, the communications interface 90 may be configured to receive, in a wired or wireless manner, the identifier of the first button that is sent by the control device according to the indication information.

The wired manner may include but is not limited to a PS2 interface manner or a USB interface manner.

The wireless manner may include but is not limited to an infrared manner, a Bluetooth® manner, a radio frequency manner, or a WiFi manner.

It should be noted that the technical solution provided by this embodiment may be used to set key value information of corresponding first buttons one by one correspondingly for every second button on the second remote control and key value information of every second button. The communications interface 90 may send a display instruction to the display device, where the display instruction is used to instruct the display device to highlight, in a first specified color (for example, green), one to-be-learned first button on the first remote control. Correspondingly, after the processor 92 has set the key value information of the first button, the communications interface 90 may further send another display instruction to the display device, where the another display instruction is used to instruct the display device to highlight the first button in a second specified color (for example, red) different from the first specified color, so as to indicate that the first button has been set. Then, the communications interface 90 and the processor 92 repeat the operations, so as to set key value information of corresponding first buttons one by one.

It should be noted that the technical solution provided by this embodiment may be further used to uniformly set key value information of corresponding first buttons correspondingly for every second button on the second remote control and key value information of every second button. The communications interface 90 may send a display instruction to the display device, where the display instruction is used to instruct the display device to highlight, in a first specified color (for example, green), one to-be-learned first button on the first remote control. Correspondingly, after sending the identifier of the first button to the first remote control, the communications interface 90 may further send another display instruction to the display device, where the another display instruction is used to instruct the display device to highlight the first button in a second specified color (for example, red) different from the first specified color, so as to indicate that the first button is subsequently to be uniformly set. Then, the communications interface 90 and the processor 92 repeat the operations until the processor 92 obtains the correspondence that includes key value information of every second button on the second remote control, and then the processor 92 may perform the rest operations, that is, uniformly set key value information of corresponding first buttons according to the correspondence.

In this embodiment, a remote control receives, by using a communications interface, key value information, which is sent by a second remote control, of a second button on the second remote control, where the key value information of the second button is information triggered by an operator by pressing the second button that corresponds to a first button displayed by a display device, where the first button displayed by the display device is a display instruction sent by a control device and received by the display device, where the display instruction is used to instruct the display device to display the first button; and further, indication information is sent to the control device, where the indication information is used to indicate a status that the key value information of the second button is received, so that the communications interface can receive an identifier of the first button that is sent by the control device according to the indication information, so that further, a processor can obtain a correspondence of key value information between the first button and the second button according to the identifier of the first button, so as to set key value information of the first button to the key value information of the second button according to the correspondence. A problem, in the prior art, of reduced operation efficiency and reduced operation reliability caused by the need of simultaneous operations on two remote controls can be avoided. By using the technical solution provided by this embodiment of the present invention, it can be implemented that another remote control is synchronously set by performing operations on one remote control and displaying, by using a display device, a to-be-learned button on the another remote control, which is easy to operate and thereby improves operation efficiency and operation reliability.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present application may be integrated into one processing unit, or each of the units may exist alone physically, or two or more units are integrated into one unit. The integrated unit may be implemented in a form of hardware, or may be implemented in a form of hardware in addition to a software functional unit.

When the foregoing integrated unit is implemented in a form of a software functional unit, the integrated unit may be stored in a computer-readable storage medium. The software functional unit is stored in a storage medium and includes several instructions for instructing a computer device (which may be a personal computer, a server, or a network device) or a processor to perform some of the steps of the methods described in the embodiments of the present application. The foregoing storage medium includes any medium that can store program code, such as a USB flash drive, a removable hard disk, a read-only memory (ROM), a random access memory (RAM), a magnetic disk, or an optical disc.

Finally, it should be noted that the foregoing embodiments are merely intended for describing the technical solutions of the present application, but not for limiting the present application. Although the present application is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present application.

What is claimed is:

1. A method for processing key value information of a remote control, comprising:

sending a display instruction to a display device, wherein the display instruction is used to instruct the display device to display a to-be-learned first button on a first remote control;

receiving indication information sent by the first remote control, wherein the indication information is sent by the first remote control after key value information, which is sent by a second remote control, of a second button on the second remote control is received, wherein the key value information of the second button is information triggered by an operator by pressing the second button that corresponds to the first button displayed by the display device, and the indication information is used to indicate a status that the key value information of the second button is received;

sending an identifier of the first button from a control device to the first remote control through a communications channel established between the control device and the first remote control according to the indication information such that the first remote control obtains a correspondence of key value information between the first button and the second button according to the identifier of the first button;

setting key value information of the first button to the key value information of the second button; and sending a second display instruction from the control device to the display device after the key value information of the first button is set to the key value information of the second button, wherein the second display instruction instructs the display device to highlight the first button in a specified color to indicate that the first button has been set.

2. The method according to claim 1, wherein the indication information is acknowledgement information used to indicate that the key value information of the second button has been received, and wherein the method further comprises establishing, by the first remote control, the correspondence of key value information between the first button and the second button according to the identifier of the first button and the key value information of the second button.

3. The method according to claim 1, wherein the indication information is the key value information of the second button, and wherein the method further comprises:

establishing the correspondence of key value information between the first button and the second button according to the identifier of the first button and the indication information;

sending the correspondence to the first remote control, wherein the correspondence comprises the identifier of the first button and the key value information of the second button such that the first remote control obtains the correspondence according to the identifier of the first button; or establishing, by the first remote control, the correspondence of key value information between the first button and the second button according to the identifier of the first button and the key value information of the second button.

4. The method according to claim 1, wherein receiving, by the first remote control, the key value information of the second button sent by the second remote control comprises receiving, by the first remote control in a wired or wireless manner, the key value information of the second button sent by the second remote control.

5. The method according to claim 1, wherein receiving indication information sent by the first remote control comprises receiving, in a wired or wireless manner, the indication information sent by the first remote control.

6. The method according to claim 1, wherein sending the identifier of the first button to the first remote control according to the indication information comprises sending the identifier of the first button to the first remote control in a wired or wireless manner according to the indication information.

7. A method for processing key value information of a remote control, comprising:

receiving key value information, which is sent by a second remote control, of a second button on the second remote control, wherein the key value information of the second button is information triggered by an operator by pressing the second button that corresponds to a first button displayed by a display device, wherein the first button displayed by the display device is displayed by the display device according to a display instruction sent by a control device, and wherein the display instruction is used to instruct the display device to display the first button;

sending indication information to the control device, wherein the indication information is used to indicate a status that the key value information of the second button is received;

receiving an identifier of the first button that is sent by the control device according to the indication information, wherein the identifier of the first button is sent from the control device to a first remote control through a communications channel established between the control device and the first remote control;

obtaining a correspondence of key value information between the first button and the second button according to the identifier of the first button;

setting key value information of the first button to the key value information of the second button according to the correspondence; and sending a second display instruction from the control device to the display device after the key value information of the first button is set to the key value information of the second button, wherein the second display instruction instructs the display device to highlight the first button in a specified color to indicate that the first button has been set.

8. The method according to claim 7, wherein the indication information is acknowledgement information used to indicate that the key value information of the second button has been received, and wherein the method further comprises establishing the correspondence of key value information between the first button and the second button according to the identifier of the first button and the key value information of the second button.

9. The method according to claim 7, wherein the indication information is the key value information of the second button, and wherein the method further comprises:

establishing the correspondence of key value information between the first button and the second button according to the identifier of the first button and the key value information of the second button; or receiving the correspondence of key value information between the first button and the second button, wherein the correspondence comprises the identifier of the first button and the key value information of the second button, and wherein the correspondence is established by the control device according to the identifier of the first button and the indication information.

10. The method according to claim 7, wherein receiving the key value information of the second button on the second remote control comprises receiving, in a wired or wireless manner, the key value information of the second button sent by the second remote control.

11. The method according to claim 7, wherein sending the indication information to the control device comprises sending the indication information to the control device in a wired or wireless manner.

12. The method according to claim 7, wherein receiving the identifier of the first button that is sent by the control device according to the indication information comprises receiving, in a wired or wireless manner, the identifier of the first button that is sent by the control device according to the indication information.

13. A control device, comprising:

a non-transitory computer readable medium having instructions stored thereon; and a computer processor coupled to the non-transitory computer readable medium and configured to execute the instruction to:

send a display instruction to a display device, wherein the display instruction is used to instruct the display device to display a to-be-learned first button on a first remote control;

receive indication information sent by the first remote control;

transmit the indication information, wherein the indication information is sent by the first remote control after key value information, which is sent by a second remote control, of a second button on the second remote control is received, wherein the key value information of the second button is information triggered by an operator by pressing the second button that corresponds to the first button displayed by the display device, and wherein the indication information is used to indicate a status that the key value information of the second button is received;

send an identifier of the first button from the control device to the first remote control through a communications channel established between the control device and the first remote control according to the indication information such that the first remote control obtains a correspondence of key value information between the first button and the second button according to the identifier of the first button;

set key value information of the first button to the key value information of the second button according to the correspondence; and send a second display instruction from the control device to the display device after the key value information of the first button is set to the key value information of the second button, wherein the second display instruction instructs the display device to highlight the first button in a specified color to indicate that the first button has been set.

14. The control device according to claim 13, wherein the indication information is acknowledgement information used to indicate that the key value information of the second button has been received.

15. The control device according to claim 13, wherein the indication information is the key value information of the second button, wherein the computer processor is further configured to execute the instructions to:

establish the correspondence of key value information between the first button and the second button according to the identifier of the first button and the indication information; and send the correspondence to the first remote control, and wherein the correspondence comprises the identifier of the first button and the key value information of the second button such that the first remote control obtains the correspondence according to the identifier of the first button.

16. The control device according to claim 13, wherein the computer processor is configured to receive, in a wired or wireless manner, the indication information sent by the first remote control.

17. The control device according to claim 13, wherein the computer processor is configured to send the identifier of the first button to the first remote control in a wired or wireless manner according to the indication information.

18. A control device, comprising:

a communications interface;

a memory, and at least one processor coupled to the communications interface and the memory, wherein the communications interface is configured to send a display instruction to a display device, wherein the display instruction is used to instruct the display device to display a to-be-learned first button on a first remote control, wherein the communications interface is further configured to receive indication information sent by the first remote control, wherein the indication information is sent by the first remote control after key value information, which is sent by a second remote control, of a second button on the second remote control is received, wherein the key value information of the second button is information triggered by an operator by pressing the second button that corresponds to the first button displayed by the display device, wherein the indication information is used to indicate a status that the key value information of the second button is received, wherein the communications interface is further configured to send an identifier of the first button from the control device to the first remote control through a communications channel established between the control device and the first remote control according to the indication information such that the first remote control obtains a correspondence of key value information between the first button and the second button according to the identifier of the first button, and sets key value information of the first button to the key value information of the second button according to the correspondence, wherein the memory stores executable program code, wherein the processor runs a program corresponding to the executable program code by reading the executable program code stored in the memory to implement a control function of the control device, wherein the control device is configured to send a second display instruction to the display device after the key value information of the first button is set to the key value information of the second button, and wherein the second display instruction instructs the display device to highlight the first button in a specified color to indicate that the first button has been set.

19. The control device according to claim 18, wherein the indication information is acknowledgement information used to indicate that the key value information of the second button has been received.

20. The control device according to claim 18, wherein the indication information is the key value information of the second button, wherein the processor is further configured to establish the correspondence of key value information between the first button and the second button according to the identifier of the first button and the indication information, and transmit the correspondence to the communications interface, wherein the communications interface is further configured to send the correspondence to the first remote control, and wherein the correspondence comprises the identifier of the first button and the key value information of the second button such that the first remote control obtains the correspondence according to the identifier of the first button.

21. The control device according to claim 18, wherein the communications interface is configured to receive, in a wired or wireless manner, the indication information sent by the first remote control.

22. The control device according to claim 18, wherein the communications interface is configured to send the identifier of the first button to the first remote control in a wired or wireless manner according to the indication information.

23. A remote control, comprising:

a communications interface;

a memory; and at least one processor coupled to the communications interface and the memory, wherein the communications interface is configured to receive key value information, which is sent by a second remote control, of a second button on the second remote control, wherein the key value information of the second button is information triggered by an operator by pressing the second button that corresponds to the first button displayed by a display device, wherein the first button displayed by the display device is a display instruction sent by a control device and received by the display device, wherein the display instruction is used to instruct the display device to display the first button, wherein the communications interface is further configured to send indication information to the control device, wherein the indication information is used to indicate a status that the key value information of the second button is received, wherein the communications interface is further configured to receive an identifier of the first button that is sent by the control device according to the indication information, wherein the identifier of the first button is sent from the control device to the remote control through a communications channel established between the control device and the remote control, wherein the memory is configured to store executable program code, wherein the processor runs a program corresponding to the executable program code by reading the executable program code stored in the memory to obtain a correspondence of key value information between the first button and the second button according to the identifier of the first button, and set key value information of the first button to the key value information of the second button according to the correspondence, wherein the control device is configured to send a second display instruction to the display device after the key value information of the first button is set to the key value information of the second button, and wherein the second display instruction instructs the display device to highlight the first button in a specified color to indicate that the first button has been set.

24. The remote control according to claim 23, wherein the indication information is acknowledgement information used to indicate that the key value information of the second button has been received, and wherein the processor is further configured to establish the correspondence of key value information between the first button and the second button according to the identifier of the first button and the key value information of the second button.

25. The remote control according to claim 23, wherein the indication information is the key value information of the second button, and wherein the processor is further configured to establish the correspondence of key value information between the first button and the second button according to the identifier of the first button and the key value information of the second button, or wherein the communications interface is further configured to receive the correspondence, which is sent by the control device, of key value information between the first button and the second button, wherein the correspondence comprises the identifier of the first button and the key value information of the second button, and wherein the correspondence is established by the control device according to the identifier of the first button and the indication information.

* * * * *